US006826931B2

(12) United States Patent
Catallo

(10) Patent No.: US 6,826,931 B2
(45) Date of Patent: Dec. 7, 2004

(54) MACHINE FOR PROCESSING A PAIR OF WETTED KNIT FABRIC TUBES FROM A COMMON CONTROL SIMULTANEOUSLY BUT INDEPENDENTLY

(76) Inventor: Frank Catallo, 84 Wheatley Rd., Old Westbury, NY (US) 11568

( * ) Notice: Subject to any disclaimer, the term of this patent is extended or adjusted under 35 U.S.C. 154(b) by 262 days.

(21) Appl. No.: 10/238,124

(22) Filed: Sep. 11, 2002

(65) Prior Publication Data

US 2004/0045326 A1 Mar. 11, 2004

(51) Int. Cl.[7] ..... D06B 3/10

(52) U.S. Cl. ..... 68/9; 68/177; 68/175; 68/184; 68/13 R

(58) Field of Search ..... 68/13 R, 9, 177, 68/178, 184, 200, 175, 176

(56) References Cited

U.S. PATENT DOCUMENTS 2,826,167 A 3/1958 Cohn et al.
3,548,616 A 12/1970 Catallo
4,269,046 A * 5/1981 Strahm et al. ..... 68/13 R
4,454,171 A * 6/1984 Diggle et al. ..... 427/209
5,469,720 A * 11/1995 Paggi ..... 68/13 R
5,546,622 A * 8/1996 McAlister et al. ..... 8/151
5,678,429 A * 10/1997 Zonco ..... 68/20
5,826,289 A 10/1998 Catallo

* cited by examiner

*Primary Examiner*—Frankie L. Stinson
(74) *Attorney, Agent, or Firm*—Charles E. Baxley

(57) ABSTRACT

A machine for processing a pair of wetted knit fabric tubes from a common control simultaneously and independently. A pair of wetted knit tube processors are operatively connected to a frame, are disposed side-by-side to each other, and are spaced-apart from each other so as to form a common operator alleyway therebetween. A controller is accessible from the operator alleyway for convenient access to either of the processors eliminating an operator from having to walk around or duck under the processors to make adjustments to the processor requiring attention. The controller is operatively connected to each of the processors independently so as to allow each of the processors to operated independently of each other from a common control, and in doing so, reduces down time by allowing one processor to operate if the other processor is not operating, and in doing so, eliminates having to shut down both of the processors if a problem occurs in one processor or an end of a wetted knit fabric tube arrives requiring the operator to rethread the wetted knit fabric tube.

24 Claims, 1 Drawing Sheet

MACHINE FOR PROCESSING A PAIR OF WETTED KNIT FABRIC TUBES FROM A COMMON CONTROL SIMULTANEOUSLY BUT INDEPENDENTLY

FIELD OF THE INVENTION

The present invention relates to a machine for processing a pair of wetted knit fabric tubes. More particularly, the present invention relates to a machine for processing a pair of wetted knit fabric tubes from a common control simultaneously but independently.

DESCRIPTION OF THE PRIOR ART

The processing of a wetted knit fabric tube has recently been improved as taught by U.S. Pat. No. 5,826,289 to Catallo.

U.S. Pat. No. 5,826,289 to Catallo teaches a wet processing system wherein a wet roped knitted fabric is treated to achieve a finished product that is flat and open and accomplished by moving the fabric so that it is transported through various processing steps in a manner that minimizes distortion and elongation of the fabric. Advantage is also provided by utilizing a J-scray that is moveably disposed in the system to fine tune the accumulation of wetness and control the speed of delivery.

Other improvements have also been made to improve the quality of the fabric produced. Little, however, has changed to increase production while maintaining quality. In the past, wetted knit fabric has been processed single strand or double strand as taught by U.S. Pat. No. 3,548,616 to Catallo et al. and claimed in U.S. Pat. No. 2,826,167 to Cohn et al.

U.S. Pat. No. 3,548,616 to Catallo et al. teaches an extractor and padder particularly suitable for use in connection with circular knit fabrics and includes a pair of vertically aligned nip rolls for expressing liquids from spread and flattened fabric tubes and a pair of horizontally aligned nip rolls located in close proximity to the vertically aligned nip rolls. A treating liquor supply pan is positioned beneath the horizontally aligned nip rolls which are partly immersed in the treating liquor, and rotation of these nip rolls draws the liquor into the nip so that a submerged nip effect is created. Apparatus is provided for driving both sets of nip rolls and for driving feed rolls of an associated fabric tube spreader.

U.S. Pat. No. 2,826,167 to Cohn et al. teaches an apparatus for treating a plurality of separate continuous lengths of textile fabrics in wet tubular form which comprises a plurality of independently adjustable apparatuses, one for each length of fabric, for separately and substantially simultaneously distending each length transversely to flattened tubular form and to a separately predetermined width. Each of the apparatuses includes apparatus for feeding longitudinally thereof the length of fabric which it distends at a speed predeterminable independently of the speed of any other length of fabric. A first common pair of squeeze rolls are of such length that they are adapted to receive side by side therebetween all lengths of fabrics from the plurality of separate distending and feeding apparatuses to apply pressure to the lengths of textile fabric to press one layer of each against the other layer thereof and to thereby squeeze any excess water out of them. A second common pair of squeeze rolls are adapted to receive side-by-side therebetween all lengths of fabric after they leave the first pair of squeeze rolls. Apparatus is located between the pairs of squeeze rolls for applying a fabric treating liquid to all the lengths of fabric while they are passing from the first common pair of squeeze rolls to the second common pair of squeeze rolls. The second common pair of squeeze rolls press the layers of each length of fabric together to regulate the liquid content thereof. The fabric treating liquid applying apparatus comprises a common pan for holding a quantity of fabric treating liquid and a common pair of rolls spaced lengthwise of the pan and each extending transversely thereof and both of the rolls being positioned to extend partially into a quantity of fabric treating liquid held in the pan. The lengths of fabric are all adapted to pass beneath both of the rolls. The submerging roll closest the first set of squeeze rolls is so positioned with respect thereto that the lengths of fabric engage it after leaving the first set of squeeze rolls above the level of the liquid in the pan and the other submerging roll is so positioned with respect to the second pair of squeeze rolls that the lengths of fabric in leaving it and passing to the second pair of squeeze rolls all do so at a point above the level of the liquid in the pan.

The two strand concept improved production over the single strand operation, however, the full potential of operating two strands with one operator was not realized because the machine had to be stopped, disabling both strands, whenever a problem occurred in one strand or a fabric end arrived requiring the operator to rethread the strand. The down time reduced potential production by 25% or more depending on fabric length and when one or the other strand would have to be rethreaded. In addition, the number of defects or holes in one or the other strand that required attention also affected down time of both strands.

It is apparent that innovations for wetted knit fabric tube processing devices have been provided in the prior art that are adapted to be used. Furthermore, even though these innovations may be suitable for the specific individual purposes to which they address, they each differ in structure and/or operation and/or purpose from the present invention as heretofore described.

SUMMARY OF THE INVENTION

ACCORDINGLY, AN OBJECT of the present invention is to provide a machine for processing a pair of wetted knit fabric tubes from a common control simultaneously but independently that avoids the disadvantages of the prior art.

ANOTHER OBJECT of the present invention is to provide a machine for processing a pair of wetted knit fabric tubes from a common control simultaneously but independently that is simple to use.

STILL ANOTHER OBJECT of the present invention is to provide a machine for processing a pair of wetted knit fabric tubes from a common control simultaneously and independently that permits the operator to keep at least one strand running 100% of the time.

STILL ANOTHER OBJECT of the present invention is to provide a machine for processing a pair of wetted knit fabric tubes from a common control simultaneously and independently that reduces total down time for maintenance.

YET ANOTHER OBJECT of the present invention is to provide a machine for processing a pair of wetted knit fabric tubes from a common control simultaneously but independently that allows one strand to be shut down for maintenance while the other strand continues to run.

BRIEFLY STATED, STILL YET ANOTHER OBJECT of the present invention is to provide a machine for processing a pair of wetted knit fabric tubes from a common control simultaneously but independently. A pair of wetted knit fabric tube processors are operatively connected to a frame, are disposed side-by-side to each other, and are spaced-apart from each other so as to form a common operator alleyway therebetween. A controller is accessible from the operator alleyway for convenient access to either of the processors eliminating an operator from having to walk around or duck under the processors to make adjustments to the processor requiring attention. The controller is operatively connected to each of the processors independently so as to allow each of the processors to operated independently of each other from a common control, and in doing so, reduces down time by allowing one processor to operate if the other processor is not operating, and in doing so, eliminates having to shut down both of the processors if a problem occurs in one processor or an end of a wetted knit fabric tube arrives requiring the operator to rethread the wetted knit fabric tube.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole FIGURE of the drawing is a diagrammatic perspective view of the machine of the present invention for processing a pair of wetted knit fabric tubes from a common control simultaneously but independently.

LIST OF REFERENCE NUMERALS UTILIZED IN THE DRAWING

Figure 1:
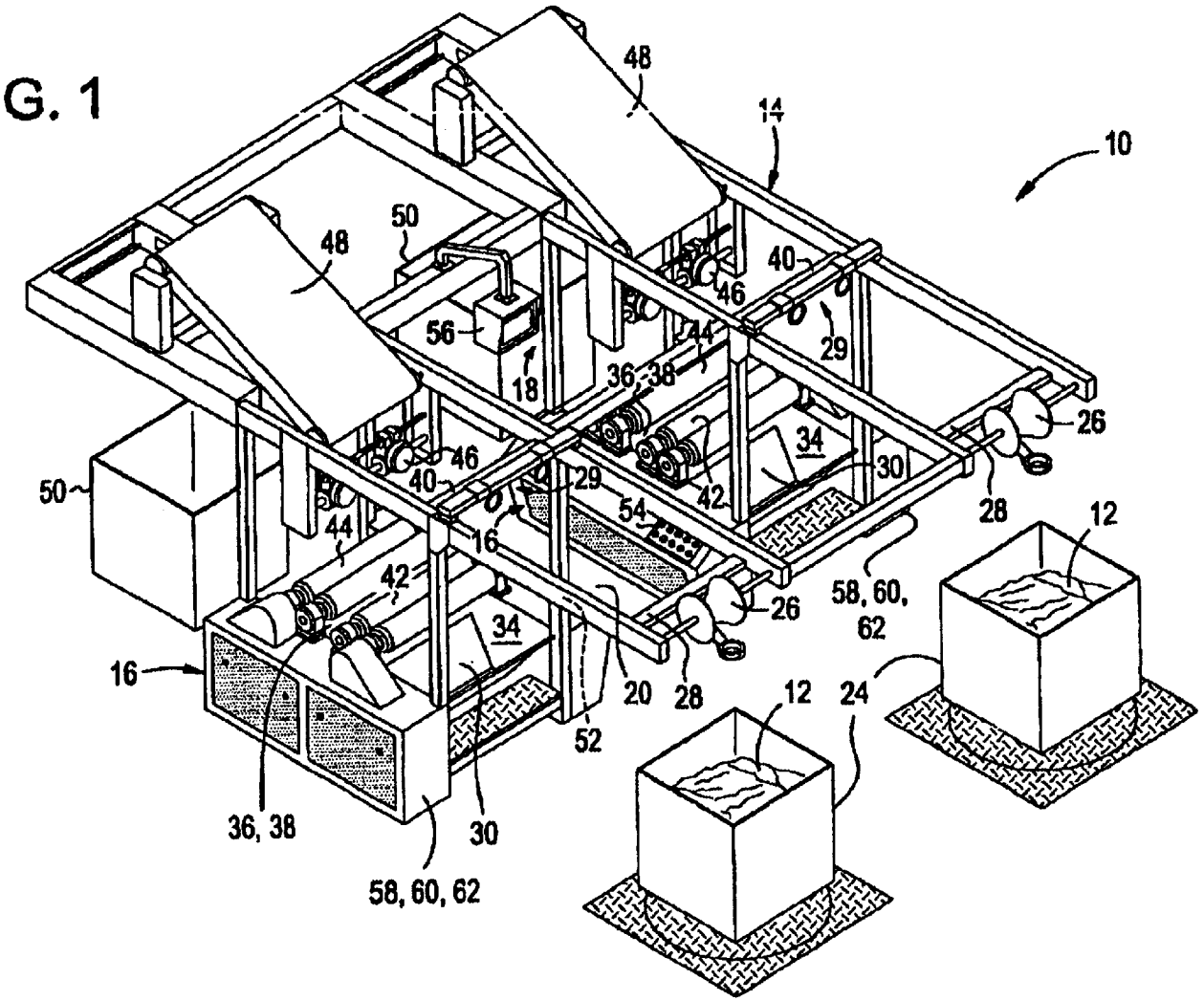

10 machine of present invention for processing pair of wetted knit fabric tubes 12 from a common control simultaneously but independently
12 pair of wetted knit fabric tubes
14 frame
16 pair wetted knit fabric tube processors
18 controller
20 common operator alleyway between pair of wetted knit fabric tube processors 16
24 truck
26 roll
28 twist sensing device
29 ring guider arrangement
30 first J-scray
34 chamber
36 second J-scray
38 separate chamber
40 feed roll
42 extracting nip
44 extracting rolls
46 spreader
48 conveyor
50 reciprocating folder
52 first control of controller 18
54 second control of controller 18
56 common touch screen of controller 18
58 detwister
60 first control accumulator
62 second control accumulator

DETAILED DESCRIPTION OF THE PREFERRED EMBODIMENT

Referring now to the sole FIGURE, which is a diagrammatic perspective view of the machine of the present invention for processing a pair of wetted knit fabric tubes from a common control simultaneously but independently, and in which like numerals indicate like parts, the machine of the present invention is shown generally at 10 for processing a pair of wetted knit fabric tubes 12 from a common control simultaneously but independently.

The machine 10 comprises a frame 14, a pair of wetted knit tube processors 16, and a controller 18. The pair of wetted knit tube processors 16 are operatively connected to the frame 14, are disposed side-by-side to each other, and are spaced-apart from each other so as to form a common operator alleyway 20 therebetween. The controller 18 is accessible from the operator alleyway 20 for convenient access to either of the pair of wetted knit tube processors 16 eliminating an operator from having to walk around or duck under the pair of wetted knit tube processors 16 to make adjustments to the wetted knit tube processor 16 requiring attention.

The controller 18 is operatively connected to each of the pair of wetted knit tube processors 16 independently so as to allow each of the pair of wetted knit tube processors 16 to operated independently of each other from a common control, and in doing so, reduces down time by allowing one wetted knit tube processor 16 to operate if the other wetted knit tube processor 16 is not operating, and in doing so, eliminates having to shut down both of the pair of wetted knit tube processors 16 if a problem occurs in one wetted knit tube processor 16 or an end of a wetted knit fabric tube 12 arrives requiring the operator to rethread the wetted knit fabric tube 12.

Each of the pair of wetted knit tube processors 16 is taught by U.S. Pat. No. 5,826,289 to Catallo, which is incorporated herein by reference thereto.

For example, a wetted knit fabric tube 12 is delivered to a wetted knit tube processor 16 normally in a truck 24. The wetted knit fabric tube 12 is drawn from the truck 24 by means of a roll 26 and moved horizontally over a twist sensing device 28 and ring guider arrangement 29 known in the art, which open the wetted knit fabric tube 12 for delivery vertically into a first J-scray 30 which is moveably balanced in a chamber 34 and which is positioned vertically below, and vertically receives the wetted knit fabric tube 12 from, the ring guider arrangement 29. Providing the first J-scray 30 of this type permits control of speed of delivery of the wetted knit fabric tube 12 and degree of wetting to a desired amount.

A second J-scray 36 similar to the first J-scray 30 is arranged in subsequent proximate relation to the first J-scray 30. The second J-scray 36 has all of the features of the first J-scray 30 and also is arranged to operate to control delivery speed and wetness. The second J-scray 36 is movably balanced in a separate chamber 38 or in the same chamber 34 as the first J-scray 30 and is normally used to apply chemicals.

The first J-scray 30 pivots around a shaft which is attached to side walls of the chamber 34 as will be understood by one skilled in the art. A first compensating apparatus, such as a balance weight, but is not limited to that, is adjusted to maintain a desired amount of the wetted knit fabric tube 12 in the first J-scray 30. When more or less of the wetted knit fabric tube 12 is delivered to the first J-scray 30 by a feed roll 40, which is rotatably mounted to the frame 14, balance is changed and a first proximity switch signals a first drive motor to either speed up or slow down to maintain desired accumulation of the wetted knit fabric tube 12 in the first J-scray 30.

In a similar manner, the second J-scray 36 receives the wetted knit fabric tube 12 from an extracting nip 42, which is rotatably and operatively connected to the first J-scray 30. When more or less of the wetted knit fabric tube 12 is delivered to the second J-scray 36 by the extracting nip 42, balanced is changed and a second proximity switch signals a second drive motor to either speed up or slow down extracting rolls 44 to maintain a desired accumulation of the wetted knit fabric tube 12 in the second J-scray 36. A spreader 46, which is operatively connected to the frame 14, receives the wetted knit fabric tube 12 from the extracting rolls 44, and then delivers the wetted knit fabric tube 12 to a conveyor 48, by following electronically the extracting rolls 44, which delivers the wetted knit fabric tube 12 to a reciprocating folder 50.

Balancing system for the second J-scray 36 is arranged different from the first J-scray 30 for convenience. A second compensating apparatus, such as a second balance weight, but is not limited to that, is located at a delivery end to maintain a desired amount of the wetted knit fabric tube 12 in the second J-scray 36. A third compensating apparatus, such as a third balance weight, but is not limited to that, is at an entry end to maintain the desired amount of the wetted knit fabric tube 12 in the second J-scray 36. Levers pivot around a shaft attached to side walls of the separate chamber 38. These levers cooperate to balance the second J-scray 36. Flow of the wetted knit fabric tube 12 from the first truck 24 to the reciprocating folder 50 is automatic and free of tension in its treating zone.

The controller 18 comprises a first control 52, a second control 54, and a common touch screen 56. The first control 52 of the controller 18 is disposed on one wetted knit tube processor 16, on one side of, and is accessed from, the common operator alleyway 20. The second control 54 of the controller 18 is disposed on the other wetted knit tube processor 16, on the other side of, and is accessed from, the common operator alleyway 20. The common touch screen 56 of the controller 18 depends from the frame 14 centrally into the common operator alleyway 20 and displays various functions of the pair of wetted knit tube processors 16. This arrangement gives the operator easy access to observe and control either of the pair of wetted knit tube processors 16 independently of the other from a common control.

Each of the pair of wetted knit tube processors 16 further comprises a detwister 58, a first control accumulator 60 to pre wet and relax the wetted knit fabric tube 12 before ballooning the wetted knit fabric tube 12 prior to extracting, and a second control accumulator 62 to saturate the wetted fabric knit 12 with chemicals prior to ballooning and extracting.

It will be understood that each of the elements described above, or two or more together, may also find a useful application in other types of constructions differing from the types described above.

While the invention has been illustrated and described as embodied in a machine for processing a pair of wetted knit fabric tubes from a common control simultaneously but independently, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A machine for processing a pair of wetted knit fabric tubes from a common control simultaneously and independently, comprising:

a) a frame;

b) a pair of wetted knit tube processors; and c) a controller;

wherein said pair of wetted knit tube processors are operatively connected to said frame;

wherein said pair of wetted knit tube processors are disposed side-by-side to each other;

wherein said pair of wetted knit tube processors are spaced-apart from each other so as to form a common operator alleyway therebetween;

wherein said controller is accessible from said operator alleyway for convenient access to either of said pair of wetted knit tube processors eliminating an operator from having to walk around or duck under said pair of wetted knit tube processors to make adjustments to a wetted knit tube processor requiring attention; and wherein said controller is operatively connected to each of said pair of wetted knit tube processors independently so as to allow each of said pair of wetted knit tube processors to operated independently of each other from a common control, and in doing so, reduces down time by allowing one wetted knit tube processor to operate if the other wetted knit tube processor is not operating, and in doing so, eliminates having to shut down both of said pair of wetted knit tube processors if a problem occurs in one wetted knit tube processor or an end of a wetted knit fabric tube arrives requiring the operator to rethread the wetted knit fabric tube.

2. The machine as defined in claim 1, wherein each of said pair of wetted knit tube processors has a roll;

wherein said roll of each of said pair of wetted knit tube processors is rotatably mounted to said frame; and wherein said roll of each of said pair of wetted knit tube processors is for drawing an associated wetted knit fabric tube from an associated truck.

3. The machine as defined in claim 2, wherein each of said pair of wetted knit tube processors has a twist sensing device;

wherein said twist sensing device of each of said pair of wetted knit tube processors is mounted to said frame; and wherein said twist sensing device of each of said pair of wetted knit tube processors is for having the associated wetted knit fabric tube moved horizontally thereover.

4. The machine as defined in claim 3, wherein each of said pair of wetted knit tube processors has a ring guider;

wherein said ring guider of each of said pair of wetted knit tube processors is mounted to said frame; and wherein said ring guider of each of said pair of wetted knit tube processors is for opening the associated wetted knit fabric tube.

5. The machine as defined in claim 4, wherein each of said pair of wetted knit tube processors has a first J-scray;

wherein said first J-scray of each of said pair of wetted knit tube processors is positioned vertically below said ring guider of an associated wetted knit tube processor;

wherein said first J-scray of each of said pair of wetted knit tube processors is movably balanced in a chamber;

wherein said first J-scray of each of said pair of wetted knit tube processors is for vertically receiving the associated wetted knit fabric tube from said ring guider of said associated wetted knit tube processor; and wherein said first J-scray of each of said pair of wetted knit tube processors is for permitting control of speed of delivery of the associated wetted knit fabric tube and degree of wetting to a desired amount.

6. The machine as defined in claim 5, wherein each of said pair of wetted knit tube processors has a second J-scray;

wherein said second J-scray of each of said pair of wetted knit tube processors is positioned subsequent to said first J-scray of said associated wetted knit tube processor;

wherein said second J-scray of each of said pair of wetted knit tube processors is movably balanced in a chamber;

wherein said second J-scray of each of said pair of wetted knit tube processors is for receiving the associated wetted knit fabric tube from said first J-scray of said associated wetted knit tube processor;

wherein said second J-scray of each of said pair of wetted knit tube processors is for permitting control of speed of delivery of the associated wetted knit fabric tube and degree of wetting to a desired amount; and wherein said second J-scray of each of said pair of wetted knit tube processors is for applying chemicals to the associated wetted knit fabric tube.

7. The machine as defined in claim 6, wherein said chamber of said first J-scray is said chamber of said second J-scray.

8. The machine as defined in claim 6, wherein each of said pair of wetted knit tube processors has an extracting nip;

wherein said extracting nip of each of said pair of wetted knit tube processors is rotatably mounted; and wherein said extracting nip of each of said pair of wetted knit tube processors is for feeding the associated wetted knit fabric tube to said second J-scray of said associated wetted knit tube processor.

9. The machine as defined in claim 8, wherein each of said pair of wetted knit tube processors has a second proximity switch;

wherein each of said pair of wetted knit tube processors has a second drive motor; and wherein balance is changed and said second proximity switch signals said second drive motor to either speed up or slow down to maintain a desired accumulation of the associated wetted knit fabric tube in said second J-scray when more or less of the associated wetted knit fabric tube is delivered to said second J-scray by said extracting nip.

10. The machine as defined in claim 8, wherein each of said pair of wetted knit tube processors has a spreader;

wherein said spreader of each of said pair of wetted knit tube processors is operatively connected to said frame; and wherein said spreader of each of said pair of wetted knit tube processors is for receiving the associated wetted knit fabric tube from said extracting nip.

11. The machine as defined in claim 10, wherein each of said pair of wetted knit tube processors has a conveyor; and wherein said conveyor of each of said pair of wetted knit tube processors is for receiving the associated wetted knit fabric tube from said spreader and delivering the associated wetted knit fabric tube to a reciprocating folder.

12. The machine as defined in claim 6, wherein said second J-scray of each of said pair of wetted knit tube processors pivots around a shaft; and wherein said shaft of said second J-scray of each of said pair of wetted knit tube processors is attached to side walls of said chamber of an associated wetted knit tube processor.

13. The machine as defined in claim 12, wherein said second J-scray of each of said pair of wetted knit tube processors has levers;

wherein said levers of said second J-scray of each of said pair of wetted knit tube processors pivot around said shaft of said second J-scray of said associated wetted knit tube processor; and wherein said levers of said second J-scray of each of said pair of wetted knit tube processors cooperate to balance said second J-scray of said associated wetted knit tube processor.

14. The machine as defined in claim 6, wherein said second J-scray of each of said pair of wetted knit tube processors has second means for maintaining a desired amount of the associated wetted fabric tube in said second J-scray of said associated wetted knit tube processor;

wherein said second means of said second J-scray of each of said pair of wetted knit tube processors is located at a delivery end of said second J-scray of said associated wetted knit tube processor for accessibility;

wherein said second J-scray of each of said pair of wetted knit tube processors has third means for maintaining the desired amount of the associated wetted fabric tube in said second J-scray of said associated wetted knit tube processor; and wherein said third means of said second J-scray of each of said pair of wetted knit tube processors is located at an entry end of said second J-scray of said associated wetted knit tube processor for accessibility.

15. The machine as defined in claim 14, wherein said second means includes a second balance weight; and wherein said third means includes a third balance weight.

16. The machine as defined in claim 5, wherein said first J-scray of each of said pair of wetted knit tube processors pivots around a shaft; and wherein said shaft of said first J-scray of each of said pair of wetted knit tube processors is attached to side walls of said chamber of an associated wetted knit tube processor.

17. The machine as defined in claim 5, wherein said first J-scray of each of said pair of wetted knit tube processors has first means for maintaining a desired amount of the associated wetted knit fabric tube in said first J-scray of said associated wetted knit tube processor.

18. The machine as defined in claim 17, wherein said first means includes a first balance weight.

19. The machine as defined in claim 5, wherein each of said pair of wetted knit tube processors has a feed roll;

wherein said feed roll of each of said pair of wetted knit tube processors is rotatably mounted to said frame; and wherein said feed roll of each of said pair of wetted knit tube processors is for feeding the associated wetted knit fabric tube to said first J-scray of said associated wetted knit tube processor.

20. The machine as defined in claim 5, wherein each of said pair of wetted knit tube processors has a first proximity switch;

wherein each of said pair of wetted knit tube processors has a first drive motor; and wherein balance is changed and said first proximity switch signals said first drive motor to either speed up or slow down to maintain a desired accumulation of the associated wetted knit fabric tube in said first J-scray when more or less of the associated wetted knit fabric tube is delivered to said first J-scray by said feed roll.

21. The machine as defined in claim 1, wherein said controller comprises a first control;

wherein said controller comprises a second control;

wherein said controller comprises a common touch screen;

wherein said first control of said controller is disposed on one wetted knit tube processor, on one side of, and is accessed from, said common operator alleyway;

wherein said second control of said controller is disposed on the other wetted knit tube processor, on the other side of, and is accessed from, said common operator alleyway;

wherein said common touch screen of said controller depends from said frame, centrally into said common operator alleyway; and wherein said common touch screen of said controller displays various functions of said pair of wetted knit tube processors for giving the operator easy access to observe and control either of said pair of wetted knit tube processors independently of the other from a common control.

22. The machine as defined in claim 1, wherein each of said pair of wetted knit tube processors comprises a detwister.

23. The machine as defined in claim 1, wherein each of said pair of wetted knit tube processors comprises a first control accumulator; and wherein said first control accumulator is for pre-wetting and relaxing an associated wetted knit fabric tube before ballooning the associated wetted knit fabric tube prior to extracting.

24. The machine as defined in claim 1, wherein each of said pair of wetted knit tube processors comprises a second control accumulator; and wherein said second control accumulator is for saturating an associated wetted knit fabric tube with chemicals prior to ballooning and extracting.

* * * * *